United States Patent [19]

Harkess

[11] 3,950,810

[45] Apr. 20, 1976

[54] GOLF CLUB CLEANING APPARATUS

[76] Inventor: James Robert Harkess, 4777 Moran Ave., Cheyenne, Wyo. 82001

[22] Filed: June 23, 1975

[21] Appl. No.: 589,593

[52] U.S. Cl. ..... 15/21 C

[51] Int. Cl.[2] ..... A63B 57/00; A46B 13/04

[58] Field of Search ..... 15/21 R, 21 A, 21 B, 15/21 C, 21 D, 21 E, 97 R, 4

[56] References Cited

UNITED STATES PATENTS

| | | | |
|---|---|---|---|
| 3,148,396 | 9/1964 | Smith | 15/21 D |
| 3,332,099 | 7/1967 | Reiter | 15/21 R |
| 3,619,841 | 11/1971 | Russell et al. | 15/21 D |
| 3,872,534 | 3/1975 | Hoag | 15/21 B |

*Primary Examiner*—Edward L. Roberts
*Attorney, Agent, or Firm*—David H. Hill; Robert E. Harris

[57] ABSTRACT

A golf club cleaning apparatus is disclosed that is capable of cleaning both right-handed and left-handed irons and woods and is also capable of cleaning the faces and the bottom of irons as well as the front driving face and sole plate of woods. A first opening into the apparatus is provided for right-handed clubs, and a second opening is provided for left-handed clubs, with each opening being designed to accept either a wood or an iron for cleaning of the same. The overall appearance of the apparatus resembles a golf ball sitting on a tee, with the upper portion being at least partially filled with a cleaning or washing liquid. A golf club is held in place after insertion through one of the openings into the device, with the bottom and back in contact with a receiving tray. Cleaning of the club head is effected by rotating a semispherical brush connected with an externally extending crank, with the brush being at least partially immersed in the cleaning liquid and maintained to contact with the front face of the club by a spring bias on the receiving tray urging the club front face in a horizontal direction toward the brush. The inlet openings into the apparatus are angularly spaced from the top of the apparatus so that a club inserted therethrough will have predetermined positioning with respect to the brushes within the apparatus to enhance club cleaning. In addition, a separate compartment is divided to accommodate foreign matter dislodged from club heads during cleaning, and this minimizes club damage during subsequent club cleaning operations.

17 Claims, 3 Drawing Figures

GOLF CLUB CLEANING APPARATUS

FIELD OF THE INVENTION

This invention relates to a cleaning apparatus, and more particularly relates to a golf club cleaning apparatus.

BACKGROUND OF THE INVENTION

In playing the game of golf, it is customary to use a plurality of clubs some of which are commonly known as woods and others of which are commonly known as irons. Obviously, when a club is used, however, it frequently is brought into ground contact, particularly at the bottom and front or driving face, and this frequently causes dirt, grass and other foreign matter to adhere to the club head. It has been found, however, that better performance can be achieved by a player if the club head of the club to be utilized is clean.

If the club is not clean, the golf ball can react erratically, and the weight of the club itself can be altered. Thus, for best shot control and to gain the proper backspin on the golf ball, a club with a clean head is desirable and perhaps in some instances necessary.

While a set of golf clubs may be customarily cleaned at the club house prior to, or after, playing a round of golf, this is not sufficient to keep the club heads clean throughout the round, due to the number of holes customarily played in a round of golf, which normally requires repeated use of the clubs. It is therefore obviously desirable to have club cleaning apparatus on the course itself to maintain the club faces clean.

While golf club cleaning devices have heretofore been suggested, none has seemed to gain wide acceptance for course usage, and improvements to such devices have therefore seemed desirable.

Among the known prior art, the patents to Smith (U.S. Pat. No. 3,148,396), Postula (U.S. Pat. No. 3,268,934), Reiter (U.S. Pat. No. 3,332,099), Perkins (U.S. Pat. No. 3,412,414), and Hash (U.S. Pat. No. 3,648,315) are directed to devices for cleaning golf clubs.

SUMMARY OF THE INVENTION

This invention provides an improved golf club cleaning apparatus that is well suited for course usage to keep the heads of golf clubs clean. The apparatus is capable of cleaning both right-handed and left-handed clubs and also capable of cleaning the faces and bottoms of both irons and woods.

It is therefore an object of this invention to provide an improved golf club cleaning apparatus.

It is another object of this invention to provide an improved golf club cleaning apparatus suitable for cleaning both right-handed and left-handed clubs.

It is yet another object of this invention to provide an improved golf club cleaning apparatus suitable for cleaning both woods and irons.

It is still another object of this invention to provide an improved golf club cleaning apparatus suitable for course usage to keep club heads clean during playing a round of golf.

It is yet another object of this invention to provide an improved golf club cleaning apparatus that has a pair of inlets one of which is for cleaning left-handed clubs and the other of which is for cleaning right-handed clubs.

It is another object of this invention to provide an improved golf club cleaning apparatus that includes means to clean the face and bottom of clubs.

It is still another object of this invention to provide an improved golf club cleaning apparatus that has a separate compartment for collection of foreign matter.

It is yet another object of this invention to provide an improved golf club cleaning apparatus that includes a semispherical brush for cleaning of clubs.

It is still another object of this invention to provide an improved golf club cleaning apparatus that includes a manually operable, spring biased, receiving tray that has brush means thereon for cleaning of golf club heads.

BRIEF DESCRIPTION OF THE DRAWINGS

With the above considerations and objects in mind, the invention itself will now be described in connection with a preferred embodiment thereof, given by way of example and not of limitation, and with reference to the accompanying drawings, in which.

DESCRIPTION OF THE INVENTION

Figure 1:
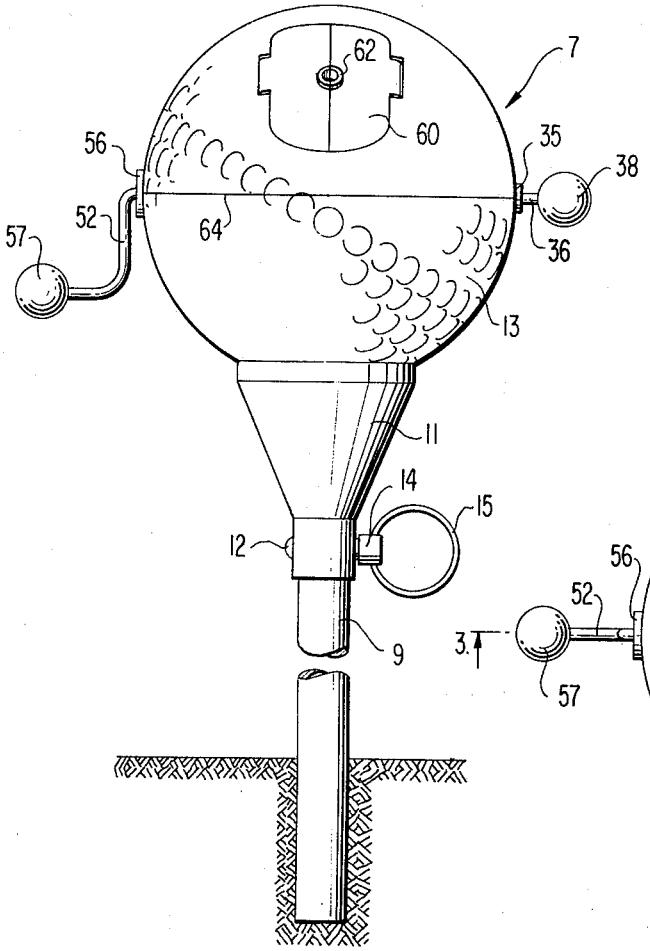
FIG. 1 is a front view of the golf club cleaning apparatus of this invention.

Referring now to the drawings, the numeral 7 indicates generally the golf club cleaning apparatus of this invention. As shown best in FIG. 1, the apparatus 7 of this invention resembles a golf ball sitting on a tee, and therefore has an excellent overall appearance, making the apparatus well suited for course usage, i.e., a plurality of the cleaning devices of this invention may be positioned throughout the course as deemed necessary or desirable for use by golfers as they play a round of golf.

Figure 3:
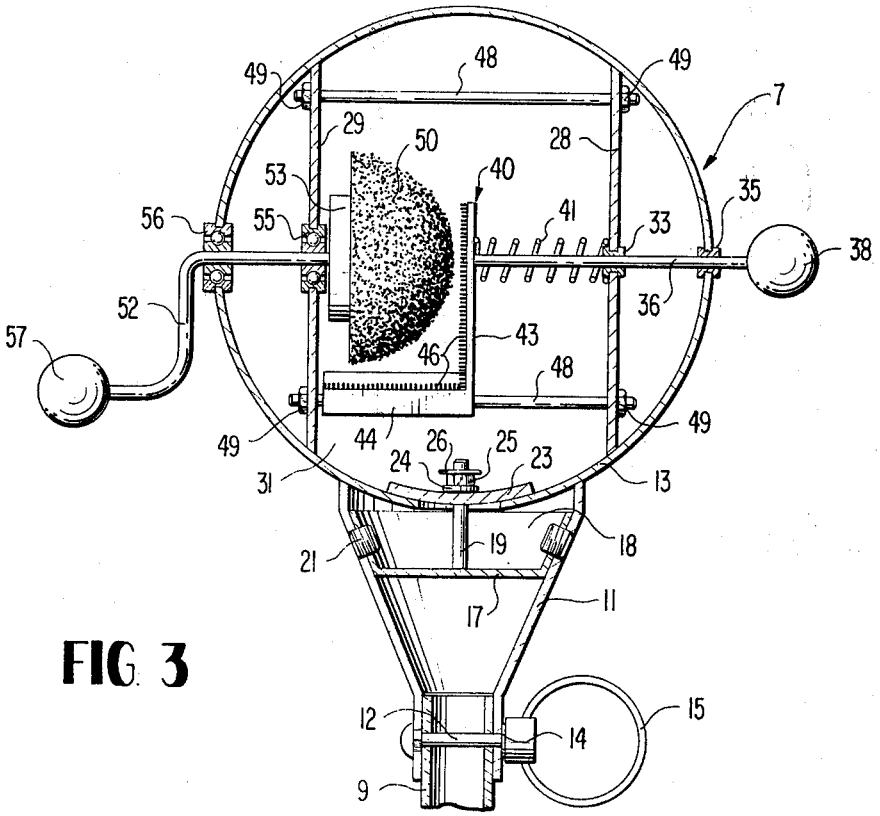
FIG. 3 is a side sectional view taken on line 3—3 of FIG. 2.

As shown in FIGS. 1 and 3, a pipe or stand 9 has the lower end embedded in the ground, with the upper end receiving an upwardly and outwardly flaring cone 11 upon which is mounted a spherically shaped cleaning mechanism 13. As is indicated in FIG. 1, sphere 13 may be dimpled, to enhance the appearance of the device, in the same manner as a golf ball; an example of dimples that can be utilized is as follows, it being understood the invention is not meant to be limited thereto:

1. Spac. = 0.10472 D Center to Center
2. Spac. = 0.05236 D Edge to Edge
3. Depth of Depression = 0.5236 D Where D equals the diamter of the mechanism.

Pipe or stand 9 is preferably a hollow pipe, as indicated in FIG. 3, with the upper end having an aperture therethrough to facilitate securing of cone 11 thereto. Cone 11 has a lower neck portion of a diameter slightly larger than the diameter of pipe 9, so that the pipe 9 is receivable therein. The lower neck portion of cone 11 has an aperture therein that is aligned with the aperture in pipe 9, with securement therebetween being achieved by a bolt 12 that extends through the apertures in the cone and pipe. A snap ring 14 is used for locking purposes at the end of the bolt outside cone 11, and a towel ring 15 may be secured onto the bolt, if desired.

Near the flared upper end of cone 11, a plate 17 is conventionally secured, as by welding, for example, and this seals the upper portion of the cone from the lower portion. Plate 17 and the upper walls of cone 11 thus form a compartment 18 for trapping dirt, grass and other foreign matter dislodged from golf clubs during washing. An upwardly extending bolt 19 is also secured to plate 17 for fastening of the sphere 13 to the cone 11. In addition, one or more plugs 21 are secured in openings in the upper portions of the walls of cone 11 above plate 17 to facilitate cleaning of the device and removal of foreign matter collecting in compartment 18.

Sphere 13 has an opening at the bottom thereof that is spanned but not completely closed by an arcuate plate 23 conventionally fastened to the sphere, as by welding, for example. Bolt 19 extends through an aperture in plate 23, and a washer 24, nut 25 and cotter key 26 may be used to secure the sphere in position on the top of cone 11.

A pair of horizontally spaced plates 28 and 29 are vertically positioned by securing the plates to the inner wall of sphere 13, as by welding, for example. A cleaning compartment 31 is provided between the bottom of sphere 13 and plates 28 and 29, and a conventional cleaning or washing solution (not shown) is preferably inserted into compartment 31 (and thus into compartment 18) to aid in cleaning of golf clubs. Plate 28 has a plurality of apertures therein with a central aperture having inserted therein a grommet 33. In addition, a grommet 35 is inserted in an aperture of sphere 13 so that a rod 36 extends through grommets 33 and 35. The outer end of rod 36 outside sphere 13 has a handle, or ball, 38 secured thereto, while the inner end of rod 36 within sphere 13 is secured to receiving tray 40. Rod 36 is movable in an axial direction, and a helical spring 41 between plate 28 and receiving tray 40 provides spring bias when the rod 36 is moved in one axial direction. In the position shown in FIG. 3, spring 41 is in an unbiased position.

Receiving tray 40 is an "L" shaped tray having a vertical member 43 and a horizontal member 44 that extends from the bottom of vertical member 43 toward plate 29. Tray 40 is designed to receive and hold any conventional wood or iron for cleaning.

Both vertical member 43 and horizontal member 44 have a flat bristle brush 46 conventionally bonded thereto, as by adhesives for example, with the brush on vertical member 43 facing plate 29, and the brush on horizontal member 44 being on the upper side thereof. Hence, a club head to be cleaned is in contact with brush 46 when the club is in a normal cleaning position established by inserting the club head through the inlet and having the bottom and rear faces contacting or contiguous with the horizontal and vertical members, respectively, of the receiving tray.

Horizontal member 44 of receiving tray 40 has a bore therethrough for receving a pair of spaced guide rods 48, which rods extend through apertures in vertical plates 28 and 29 and have self-locking nuts 49 conventionally securing the rods in place. A third rod 48 is received in apertures near the top of each of vertical plates 28 and 29, in the top center portion of each, for stabilizing the plates, with this rod also having nuts 49 at opposite ends. Thus, receiving tray 40 is slidable along the lower guide rods 48 as desired.

A brush 50, preferably semispherical although other configurations may be utilized as needed or desired, is mounted on one end of crank rod 52 by a snap nut 53. The bristles of the semispherical brush are configured by extending the length of the bristles in the area midway between the apex and base of the semisphere brush to accommodate the greater lofts of some of the club heads, which reduces the spaced area above the receiving tray 40. Rod 52 extends through bearing 55 in wall 29 and bearing 56 in the wall of sphere 13, with the outer end of the crank having a handle, or ball, 57 secured thereto. Upon rotation of crank 52, brush 50 will, of course, be rotated.

Figure 2:
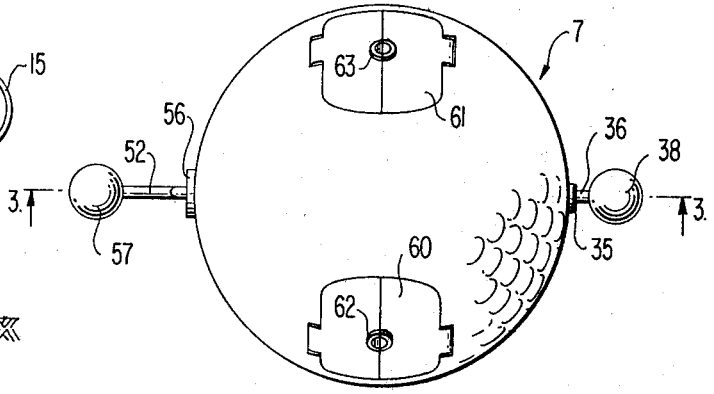
FIG. 2 is a top view of the golf club cleaning apparatus as shown in FIG. 1.

As in FIGS. 1 and 2, a pair of inlet doors 60 and 61 are provided, through which a club head to be cleaned is inserted into the apparatus. Door 60 is for right-handed clubs (irons or woods) while door 61 is for left-handed clubs (irons or woods). As shown, grommets 62 and 63 are placed in doors 60 and 61, respectively, to protect club shafts from being damaged during club head cleaning. Doors 60 and 61 may be conventional, and preferably are hinged at opposite sides with each door being biased to the closed position in a conventional fashion.

Doors 60 and 61 are spaced from the top of sphere 13 a predetermined distance. Since the average lie of a standard golf club is between 53° and 57° , doors 60 and 61 are positioned such that when a club head is inserted and in the cleaning position in contact with tray 40 (whether a right-handed or lefthanded club), the front face of the club on tray 40 will be properly oriented to insure proper cleaning action by the semispherical brush. It has been found that in positioning doors 60 and 61 a midrange of 55° is preferred. Brush 50 is of a semispherical configuration to meet the different lofts encountered on the different clubs to be cleaned.

As shown by line 64 in FIG. 1, sphere 13 may be composed of a pair of hemispheres that are held together in a conventional fashion. This arrangement provides ready access to the interior of the washing apparatus as needed.

In operation, a golf club is inserted into the cleaning apparatus through the proper inlet door (depending upon whether the club is a right-handed club or a left-handed club), and the club head is brought into contact with receiving tray 40. At this point the club face is toward brush 50, and handle 38 can be used to withdraw or displace the tray in a horizontal direction away from the brush and enable the club head to be received in the tray. When this occurs, spring 41 will then bias the receiving tray so that the front face of the club head comes into contact with brush 50, and the club will be held in the cleaning position by the several elements of the apparatus, including the inlet doors.

Brush 50 is rotated by crank 52 (either clockwise or counterclockwise), and the rotating of brush 50 cleans the front face of the club. At the same time, the agitation produced by rotating brush 50 moves the club head, and this limited movement is sufficient so that the bottom of the club and rear face are cleaned by brush 46 on receiving tray 40, so that the club head is cleaned without having to reposition the same during the cleaning operation. The club is then retracted from the apparatus and is ready for use, after drying the club head, if desired. The cleaning solution in the cleaning compartment 31 of the apparatus should be maintained in a sufficient quantity to at least partially immerse the brush and club head when in the cleaning position, and dislodged dirt, grass and other foreign matter will settle into the lower compartment 18 and be trapped therein to help keep subsequently cleaned clubs from being damaged by foreign matter dislodged from clubs cleaned earlier. Compartment 18 should, of course, be cleaned by removing plugs 21 and flushing the compartment at a frequency depending upon the amount of use of the device.

The invention is not to be considered as being limited to the particular details given, nor to the specific application to which reference has been made during the description of the preferred embodiment of the invention, but should be considered as extending to encompass all such revisions and modifications as would be obvious to a workman of ordinary skill in the art.

What is claimed is:

1. A golf club cleaning apparatus, comprising:

a housing having access means through which a golf club may be inserted for cleaning the head thereof;

receiving means within said housing for receiving the head of a golf club inserted through said access means and for establishing a cleaning position when the head of said golf club is in a predetermined position with respect to said receiving means;

first brush means fixed to a portion of said receiving means to contact at least the bottom of a club head when said club head is in said cleaning position;

second brush means mounted for movement within said housing and contacting the face of a club head when said club head is in said cleaning position; and actuating means for causing movement of said second brush means to clean the face of said club head and cause limited movement thereof, said limited movement of said club head causing said first brush means to clean the bottom of said club head while the face is being cleaned by said second brush means.

2. The golf club cleaning apparatus of claim 1, wherein said housing is spherically shaped.

3. The golf club cleaning apparatus of claim 1, wherein said access means of said housing includes a pair of inlet doors, one of which receives right-handed clubs and the other of which receives left-handed clubs, the positioning of said inlet doors being determined by the average lie of clubs to be cleaned.

4. The golf club cleaning apparatus of claim 3, wherein each of said inlet doors receives both irons and woods.

5. The golf club cleaning apparatus of claim 1, wherein said receiving means includes an L-shaped receiving tray, a rod fixed to said tray and extending therefrom externally of said housing, and a biasing spring, whereby said receiving tray may be manually displaced from a normal position and a restoring bias automatically established.

6. The golf club cleaning apparatus of claim 1, wherein said first brush means contacts the bottom and rear face of a club head when in such cleaning position.

7. The golf club cleaning apparatus of claim 1, wherein said second brush means is a semispherical brush.

8. The golf club cleaning apparatus of claim 7, wherein said actuating means is a manual crank extending externally of said housing and connected with said semispherical brush to cause rotation thereof.

9. The golf club cleaning apparatus of claim 1, wherein said housing includes a cleaning compartment in which compartment is located said receiving means and said second brush means, and a second compartment connected with said cleaning compartment for collecting matter dislodged from said club heads during cleaning.

10. A golf club cleaning apparatus, comprising:

a housing having access means through which a golf club may be inserted for cleaning the head thereof, said housing having a cleaning compartment at least partially filled with liquid washing solutions;

a receiving tray within said cleaning compartment of said housing for receiving the head of a golf club inserted through said access means and for establishing a cleaning position when the head of said golf club is in a predetermined position with the bottom and rear face continguous to said cleaning means;

first brush means fixed to a portion of said receiving tray and contacting at least the bottom of a club head within said cleaning compartment and in said cleaning position;

second brush means mounted for movement within said cleaning compartment within said housing and contacting said cleaning solution therein, said second brush means being positioned so that a club head in cleaning position is between said second brush means and said receiving tray with said second brush means adjacent the front face of said club head;

manual means connected with said receiving tray for moving said receiving tray in opposite predetermined directions toward and away from said second brush means, a portion of said manual means being external of said housing;

biasing means connected with said manual means for establishing a restoring bias when said receiving tray is moved in said predetermined direction away from said second brush means whereby said biasing means causes a club head between said second brush means and said receiving tray to have the front face thereof brought into contact with said second brush means; and actuating means for causing movement of said second brush means to clean the face of said club head and cause limited movement thereof, said limited movement of said club head causing said first brush means to clean the bottom of said club head while the face is being cleaned by said second brush means.

11. The golf club cleaning apparatus of claim 10, wherein said access means of said housing includes a pair of inlet doors each of which receives both woods and irons and one of which is positioned to accept right-handed clubs for cleaning and the other of which is positioned to accept left-handed clubs for cleaning, the positioning of said inlet doors being determined by the average lie of woods and irons to be cleaned.

12. The golf club cleaning apparatus of claim 10, wherein said second brush means is a rotatable semispherical brush, and wherein said actuating means has a portion extending outside said housing for permitting said semispherical brush to be manually rotated.

13. The golf club cleaning apparatus of claim 10, wherein said housing has a second compartment below and communicating with said cleaning compartment, said second compartment having said liquid washing solution therein and collecting foreign matter dislodged from said club heads during cleaning in said cleaning compartment.

14. A golf club cleaning apparatus, comprising:

a spherically shaped housing having first and second spaced inlet doors therein, said first and second inlet doors being positioned on opposite sides of the upper portion of said spherically shaped housing to receive right-handed and lefthanded clubs, respectively, the heads of which are to be cleaned, said inlet doors being of sufficient size to permit both irons and woods to be received therethrough;

wall means within said housing establishing a cleaning compartment that is at least partially filled with a liquid washing solution;

an L-shaped receiving tray having a horizontal member and a vertical member within said cleaning compartment for receiving the head of a golf club inserted through one of said inlet doors and establishing a cleaning position when the head of said golf club is in a predetermined position with the bottom and rear face contiguous to said horizontal and vertical members, respectively, of said receiving tray;

flat brushes fixed to said horizontal and vertical members of said receiving tray so that said brushes are in contact with the bottom and rear face of a club head when in the cleaning position within said cleaning compartment of said housing;

a semispherical brush mounted for rotation within said cleaning compartment and contacting said washing solution therein, said semispherical brush being positioned so that a club head in said cleaning position is between said semispherical brush and said receiving tray with the front face of said club head adjacent to said semispherical brush;

manually operable means connected with said receiving tray for causing movement of said tray in opposite predetermined horizontal directions toward and away from said semispherical brush, said manually operable means having a portion extending externally of said housing;

biasing means connected with said manually operable means to establish a bias whenever said receiving tray is moved in a direction away from said semispherical brush so that a club head between said semispherical brush and said receiving tray will be biased toward contact between the front face of the club head and said semispherical brush;

crank means connected with said semispherical brush for effecting rotation thereof, rotation of said semispherical brush causing cleaning of the front face of a club head in contact with said brush and causing limited movement of said club head which causes said flat brushes to clean the bottom and rear face of said club head while the front face is being cleaned by said semispherical brush; and a conically shaped housing section below and connected with said spherically shaped housing, said conically-shaped housing having a collecting compartment therein communicating with the cleaning compartment of said spherically shaped housing and having said washing solution therein, whereby foreign matter dislodged from a club head in the cleaning compartment settles into said collecting compartment.

15. The golf club cleaning apparatus of claim 14, wherein said first and second inlet doors are positioned at a midrange of 55° to accommodate irons and woods in normal use having an average lie between 50° and 57°.

16. The golf club cleaning apparatus of claim 14, wherein said conically shaped housing section has drain plugs therein for cleaning of said apparatus.

17. The golf club cleaning apparatus of claim 14, wherein said apparatus includes a pipe that extends vertically downwardly from said conically shaped housing section, and wherein said spherically shaped housing has dimples therein so that said apparatus resembles a golf ball on a tee.

* * * * *